United States Patent [19]

Goodley

[11] 4,407,274

[45] Oct. 4, 1983

[54] CERVICAL TRACTION DEVICE

[76] Inventor: Paul H. Goodley, 2210 W. 3rd St., Los Angeles, Calif. 90057

[21] Appl. No.: 270,781

[22] Filed: Jun. 5, 1981

Related U.S. Application Data

[63] Continuation-in-part of Ser. No. 135,895, Mar. 31, 1980, abandoned.

[51] Int. Cl.[3] ..... A61H 1/02

[52] U.S. Cl. ..... 128/69; 128/87 B

[58] Field of Search ..... 128/69, 70, 71, 75, 128/327, DIG. 15, 87 B; 272/126, 137, 143

[56] References Cited

U.S. PATENT DOCUMENTS

| | | | |
|---|---|---|---|
| D. 209,759 | 1/1968 | Snyder | 272/126 |
| 2,633,124 | 3/1953 | Yellin | 128/75 |
| 2,954,026 | 9/1960 | Spinks | 128/75 |
| 3,108,587 | 10/1963 | Das | 128/75 |
| 3,221,735 | 12/1965 | Goodman | 128/75 |
| 3,540,439 | 11/1970 | Gaylord | 128/75 |
| 3,572,327 | 3/1971 | Beard | 128/75 |
| 3,604,412 | 9/1971 | Gardner | 128/75 |
| 3,871,366 | 3/1975 | Cotrel | 128/75 |

*Primary Examiner*—Richard J. Apley
*Assistant Examiner*—David J. Brown
*Attorney, Agent, or Firm*—Edward A. Sokolski

[57] ABSTRACT

A cervical traction device in which the user, himself, applies the traction force. A harness which is adjustable both as to size and shape fits about the user's head between the occiput and forehead. A strap is attached to the harness and is used to apply traction thereto, the opposite ends of the strap being attached to the ends of a traction bar. The traction bar has attachment means at its center and to the left and right of center, a line or cable being selectively attached to one of these attachment means. The line fits through a suitable fitting so that it reverses direction to a position forward of the user's head where it is attached to a force indicator device which is within the user's view. Another line runs from the opposite end of the indicator device to a force input drive member adapted to be engaged by the user's feet. In using the device, the user applies the desired amount of force to the force input drive member, as indicated on the indicator device, this force being delivered to the user's neck.

13 Claims, 11 Drawing Figures

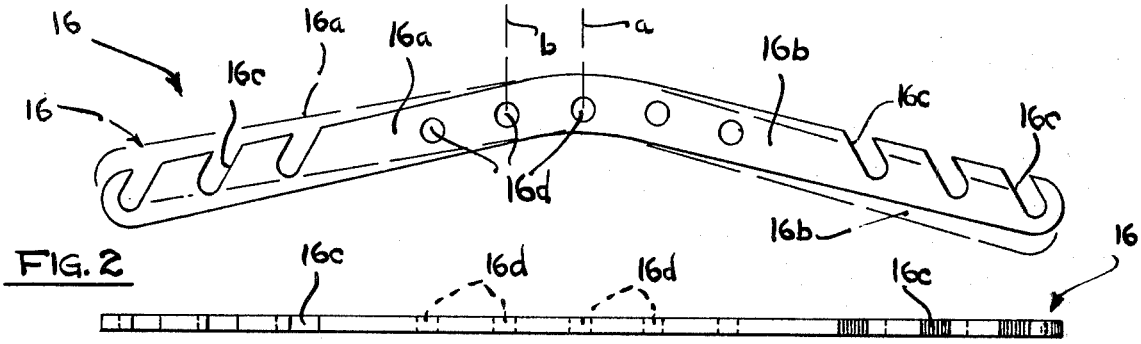
FIG. 2
FIG. 3
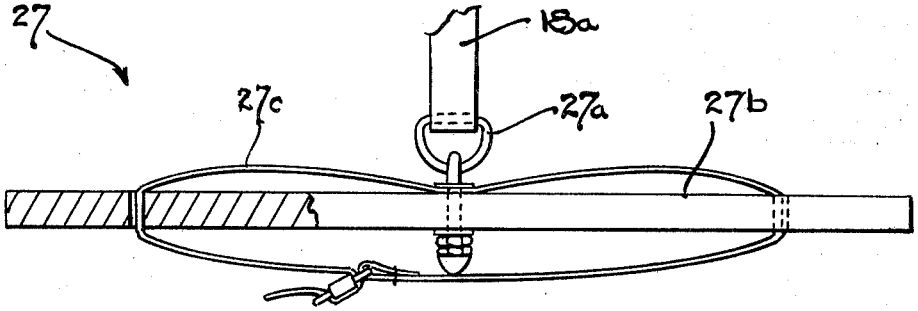
FIG. 4
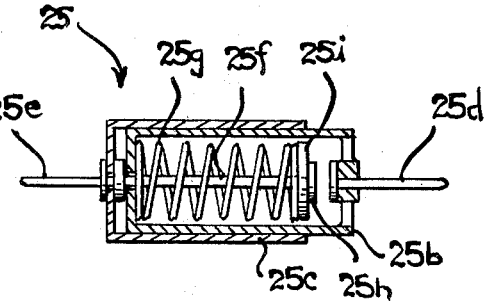
FIG. 5
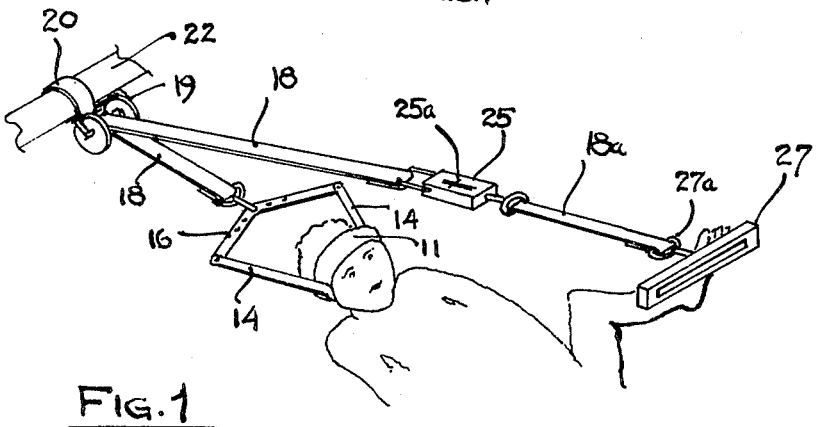
FIG. 1

14
14d
14c
14a
11
11a
11b
11c
11e
11f
9
14b

CERVICAL TRACTION DEVICE

This application is a continuation-in-part of my Application Ser. No. 135,895, filed Mar. 31, 1980 now abandoned.

This invention relates to a cervical traction device, and more particularly to such a device in which the user thereof himself applies the traction force.

Cervical traction devices of the prior art for applying traction to the cervical spine often employ cervical halters which run under the chin of the user. With this type of device, the cervical force has a likelihood of being improperly directed in that although the harness may be optimally adjusted to the particular head shape in an attempt to deliver the major part of the force from posteriorly, as is desired, often too much force is directed along the chin strap. Also, many prior art traction devices are not adapted to apply traction to a reclining patient with a force that assures traction in flexion. Further, such prior art devices do not provide for versatility of adjustment to enable the force to be delivered at any desired position on the neck to allow traction to a particular desired location asymmetrically either to the left or the right of center or with a rotational component, as particular thereapeutic needs may require.

Prior art cervical traction units are available for home use by a patient. Such units, however, have the following shortcomings. First, such units generally do not enable the application of intermittent traction which has certain therapeutic advantages. Many prior art devices employ bags of water or varying solid weights to provide static traction. In certain systems, it is possible for the patient to pull on the traction line to provide his own force. However, in such systems, no means are provided for measuring the amount of force being applied so that such force cannot be properly adjusted to suit the individual treatment requirements. Further, prior art cervical harnesses are manufactured to fit a general head shape and cannot be adjusted to the individual head shape and size of the user, which often detracts from the proper application of traction force.

The chin strap type of harness has several disadvantages. First, with this type of harness it is possible to deliver excessive force through to the chin to the joints of the jaw, thereby compounding the injury. Secondly, this type of harness forces the individual's mouth closed, which is somewhat discomforting and limits the individual's ability to talk.

The device of the present invention overcomes the aforementioned shortcomings of the prior art by avoiding the use of a chin strap and in the preferred embodiment employing a harness which fits around and adapts to both the size and the shape of the user's head. The harness, which is adjustable in both size and shape, fits about the user's head between the posterior aspect of the head (the occiput) and the forehead. The harness may be removably held to the user's head by the use of suitable attachment means such as Velcro material. In the preferred embodiment, a strap for applying traction through the harness is removably attached thereto at a selected position which may be in the center to provide neutral rotation, or to the left or right of center to provide rotation either to the left or the right, as the particular situation may require. In an alternative embodiment of the invention, the harness and strap are integrated into a single unit and the harness may not wrap around the user's forehead. The ends of the strap are attached to the opposite ends of a traction bar, this traction bar having attachment means both at the center thereof and at various positions to the left and right of center. A line which may be of webbing, rope or cable is attached to the traction bar at one of the attachment positions thereof, the central attachment position providing symmetrical traction while asymmetrical traction of various degrees can be applied by attachment to other positions to the left or right of center. The line fits through a suitable fitting so that it reverses direction to a position forward of the head of the user where it is attached to a force indicator device, the scale of which is within the user's view. A line runs from the opposite end of the indicator device to a force input drive member which is adapted to be engaged by the user's foot.

In using the device, the user applies the desired amount of force to the force input drive member as indicated on the indicator device, this force being delivered precisely to the neck as prescribed by the doctor, either symmetrically or asymmetrically, with or without rotation, and with selected degrees of flexion and lateral bending.

It is therefore an object of this invention to provide an improved cervical traction device for use by a patient wherein he himself, by his own force, can apply the required amount of traction.

It is a further object of this invention to provide a cervical traction device employing an adjustable harness for the user's head and which can be adjusted to provide both rotation and asymmetrical traction in accordance with the user's needs.

Other objects of the invention will become apparent as the description proceeds in connection with the accompanying drawings of which:

FIG. 1 is a schematic drawing illustrating the device of the invention in use;

FIG. 2 is an elevational view of a preferred embodiment of the traction bar employed in the device of the invention;

FIG. 3 is a top plan view of the traction bar of the preferred embodiment;

FIG. 4 is a side elevational view of the force input drive member employed in the preferred embodiment;

FIG. 5 is a cross-sectional side elevational view of the force indicating means of the preferred embodiment;

Figures 6, 7, 8, 9, 10, 11:
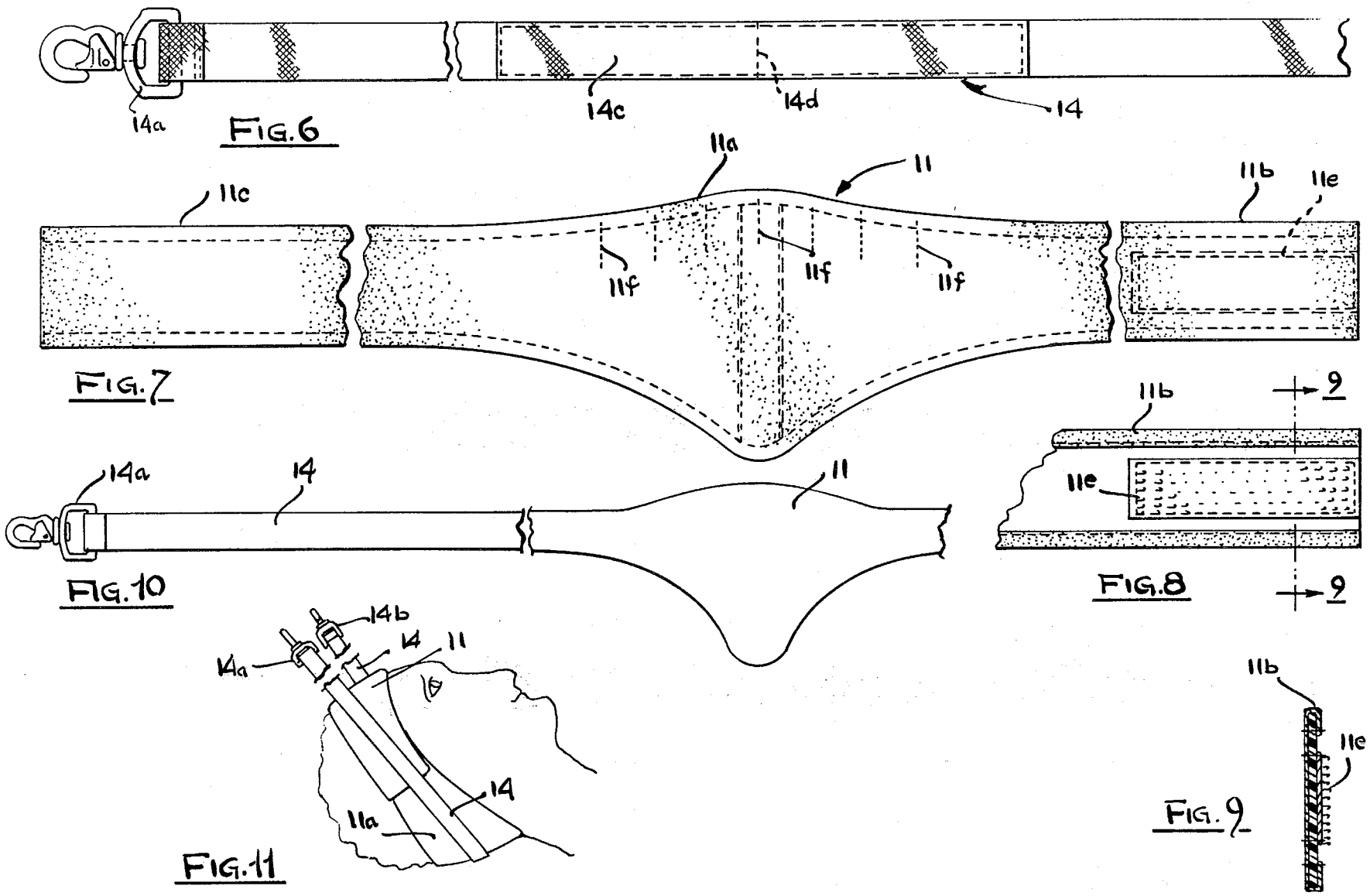
FIG. 6 is a top plan view of the traction strap of the preferred embodiment.
FIG. 7 is a top plan view of the harness of the preferred embodiment.
FIG. 8 is a view illustrating the attachment means employed in the harness of the preferred embodiment.
FIG. 9 is a cross-sectional view, taken along the plane indicated by 9—9 in FIG. 8.
FIG. 10 is a modified version of the strap and harness of the invention wherein these two elements are combined in a single unit.
FIG. 11 is a schematic drawing illustrating the harness and traction strap of the preferred embodiment of the invention attached to a user's head.

Referring now to FIG. 1, a preferred embodiment of the device of the invention is illustrated in use. Harness 11 is wrapped around the forehead of the individual requiring traction and held in position by suitable means as Velcro fasteners. The harness is fabricated of a soft, flexible material so that in its wrapped-around position it conforms to the size and shape of the user's head. Removably and adjustably attached to the harness at a preselected position along the rearward portions thereof is traction strap 14. This strap, as to be explained further on in the specification, may be removably attached to the harness by means of Velcro fasteners at a central position along the harness to provide neutral rotation during traction, or at positions to the left or right of center to provide rotation in the traction. The opposite ends of traction strap 14 are removably attached to traction bar 16 (either at the ends thereof or to other attachment points), as to be explained further on in the specification. Attached to an attachment part of bar 16, which either may be at the center thereof or to the right or left of center, depending on whether symmetrical or asymmetrical traction is desired, is a traction line or strap 18 which may comprise webbing. Line 18 runs through pulley 19 and doubles back on itself. Pulley 19 is supported by means of strap 20 which runs around bar 22 which is also fixedly supported. Bar 22 may comprise a bar mounted between the lower portions of the jambs of a door, or the pulley may be mounted on a strap for insertion and fixation in a door hinge space. In lieu of a pulley, a "D" ring or buckle may be used.

The other end of cable 18 is attached to one end of force indicator 25 which has a scale **25*a* thereon which indicates the force applied to strap 18 which is indicative of traction force being applied to the user. The other end of force indicator 25 is connected by means of strap 18*a* to a force input drive member 27** which may be in the shape of a bar with foot straps suitable for receiving the feet of the user in force-applying relationship, as indicated in the figure.

In using the device, the user applies force with his feet against force input drive member 27, the amount of this force being indicated on the indicator scale **25*a* of force indicating device 25. Traction can be applied intermittently by the user and in the amounts prescribed by the doctor which will be indicated on scale 25*a*. Further, by preadjusting strap 14 relative to harness 11, various amounts of left or right rotation can be provided as may be required for the individual treatment. In addition, various amounts of asymmetrical traction can be provided by the preselection of the attachment point of strap 18 to traction bar 16**, as may be prescribed by the therapist or doctor.

Referring now to FIGS. 2 and 3, traction bar 16 of the preferred embodiment is illustrated. Traction bar 16 is fabricated of a suitable, relatively rigid metal or plastic and is flat in configuration, having a pair of arms **16*a* and 16*b* which form a wide "V". The bar has a plurality of spaced grooves 16*c* and apertures 16*d* near the ends of the arms thereof for use in attachment the traction strap 14 thereto. Grooves 16*c* are symmetrically arranged in pairs on arms 16*a* and 16*b*. A plurality of attachment apertures 16*d* are provided in the central portion of the traction bar to provide attachments for strap 18. One of these apertures, as indicated by line "a" in FIG. 2, is at the geometric center of the bar for use in providing symmetrical traction, the others of these apertures being to the left and right of center for use in providing various degrees and types of asymmetrical traction. For illustrative purposes, the bar is shown by the dashed lines in FIG. 2 in an asymmetrical traction position effected by connecting the strap 18 to the aperture opposite dashed line "b". It is to be noted that asymmetrical traction can be provided by selective attachment of strap 14 to various combinations of attachment points 16*c***.

Referring now to FIG. 4, the force input drive member of the preferred embodiment is illustrated. This member is in the general shape of a bar and has a "D" ring **27*a* to which strap 18*a* is attached (see FIG. 1). A transverse, flat bar 27*b* is provided in this member for engagement by the foot of the user when applying traction, as shown in FIG. 1. The bar has a strap 27*c*** for holding the user's feet in place.

Referring now to FIG. 5, the force indicator 25 of the preferred embodiment is schematically illustrated. This device comprises a pair of slidably engaging cylindrical casing portions **25*b* and 25*c* which are fitted together telescopically. A ring 25*d* is fixedly attached to casing 25*b* at one end wall of the device, while a ring 25*e* is fixedly mounted on the other end wall of the device and is fixedly joined to a rod 25*f* which fits through the end walls of casings 25*c* and 25*b*. The opposite end of rod 25*f* has a disc-shaped head 25*h* thereon, there being a second larger disc or washer 25*i* slidably mounted on the rod in abutment against head 25*h*. Mounted on rod 25*f* between an end wall of casing 25*b* and washer 25*i* is coil spring 25*g*. An indicator scale is marked along the wall portion 25*a* of casing 25*b*, such that the force applied between rings 25*d* and 25*e* will cause casing 25*b* to be telescopically withdrawn from casing 25*c* against the force of spring 25*g* in an amount proportional to the force applied to the indicator device, which will cause a corresponding compression of the spring and relative displacement between casings 25*b* and 25*c*, this relative displacement being indicated on indicator scale 25*a* (see FIG. 1). In this manner, a continuous indication is provided to the user of the force applied to straps 18 and 18*a***.

Referring now to FIG. 6, the traction strap 14 of the preferred embodiment is illustrated. This strap is made of a strip of non-stretch material having hooks **14*a* and 14*b* attached to the opposite ends thereof (refer additionally to FIG. 11). At the central portions of the strap, a Velcro fastener strip 14*c* is provided for use in removably attaching the strap to harness 11, as shown in FIG. 11**.

Referring now to FIGS. 7, 8 and 9, the harness 11 of the preferred embodiment is illustrated. The harness has a central portion **11*a* which is widened for convenient fitting against the occipital region of the user's head and narrower end portions 11*b* and 11*c* which are joined together in abutment with each other by means of Velcro fasteners 11*e* which can best be seen in FIGS. 8 and 9. Harness 11 is preferably made of a cushioning material which may include a foam rubber lining. The harness, being flexible, follows the contour of the user's head and by virtue of its adjustable attachment adjusts to the size of the head, as can be seen in FIG. 11**.

A plurality of markers **11*f* are formed along the central portion of the harness, for example, by stitching. One of these markers is at the geometric center of the harness with others being equally spaced to either side of center and are used in conjunction with a similar marker 14*d* (see FIG. 6) on strap 14 for positioning the strap relative to the harness to provide either no rotation or various degrees of rotation to the right or left in applying the traction. Thus, with the marker 14*d* directly opposite the central one of markers 14*f*, no rotation is provided, while various degrees of rotation to the left and right can be provided by positioning marker 14*d* opposite one of the left or right of center markers 14*f***, as may be prescribed by the doctor or therapist.

Referring now to FIG. 7, an alternate configuration for the strap and harness is shown wherein these two units are integrated into a single unit and the harness need not wrap around the forehead. In the use of this device, the harness portion fits against the occipit of the user's head. With this alternate configuration, no rotational adjustment is possible, except as provided by the use of the traction bar. However, this is a convenient piece for use in therapy where no rotation may be needed or where the device is being used in a non-therapeutic situation where the strengthening of the muscles or non-medical traction is the objective of the user of the device and the fitting of the device around the user's head may not be necessary.

It is to be noted that the strap may be placed high or low on the harness to deliver traction to the entire neck or any section thereof.

While the device has been described and illustrated in detail, it is to be clearly understood that this is intended by way of illustration and example only and is not to be taken by way of limitation, the spirit and scope of this invention being limited only by the terms of the following claims.

I claim:

1. In a cervical traction device for use in applying traction to the cervical spine of a user comprising harness means a portion thereof which fits against the occiput of the user's head, traction strap means removably attached to said portion of said harness means at a preselected position therealong, said traction strap being positionable along said portion of said harness means at any selected position thereon, attachment means fixedly attached to said strap means at each of the opposite ends thereof, a traction bar positioned above the user's head, the attachment means being removably connected to said traction bar near the opposite ends thereof, line means attached to said traction bar at a predetermined position therealong, means for doubling said line means back on itself so that it returns to a position below the user's head, a force indicator device positioned within view of the user attached at one end to said line means, second line means attached at one end thereof to the other end of said force indicator device, force input drive means attached to the other end of said second line means for receiving a force input from the user, whereby the force applied by the user to said force input drive means is applied to the user's neck in a predetermined symmetrical or asymmetrical manner which is in accordance with the attachment position of said traction strap means, said force being indicated on said indicator device.

2. The device of claim 1 wherein said harness means comprises a flexible soft material adapted to be wound around the user's head to conform to the size and shape thereof.

3. The device of claim 2 wherein said harness means has a central widened portion which is adapted to fit against the dorsal and neck portions of the user's head, and end portions have fastener means therein for joining said end portions together.

4. The device of claim 2 wherein said strap means comprises a single narrow strap and means for fastening said strap to said harness at any position therealong.

5. The device of claim 4 wherein said strap has a marker at the center thereof, said harness having a marker at the center thereof and markers to the left and right of center for use in setting the strap at predetermined positions along the harness.

6. The device of claims 3 or 4 wherein said fastening means for said harness means and for said strap means comprises Velcro fasteners.

7. The device of claims 1 or 4 wherein said traction bar comprises a flat bar having a pair of arms forming a wide "V", said bar having a plurality of spaced grooves near the ends of the arms thereof for use in attaching the attachment means to the traction bar.

8. The device of claim 7 wherein said attachment means comprises hooks attached to the opposite ends of the strap means.

9. The device of claim 1 wherein the traction bar has an aperture in the center thereof and apertures to the right and left of said center for use in selectively attaching said line means to said predetermined position therealong.

10. The device of claim 1 wherein said force indicator device comprises a pair of slidably engaging concentric casing portions fitted together telescopically, and spring means mounted in the inner one of said casing portions for resiliently urging said casing portions towards each other, and scale means on one of said casing portions whereby when a force is applied between the casing portions said casing portions are drawn apart against the force of the spring means to provide an indication of the applied force on said scale means.

11. The device of claims 1 or 9 wherein said means for doubling the line means back on itself comprises a pulley around which the line means runs and means for supporting said pulley.

12. The device of claim 1 wherein said force input drive means comprises a member in the general shape of a bar having strap attachment means at its center and foot straps supported thereon and adapted for engagement by the feet of the user for applying traction.

13. The device of claim 1 wherein the harness means and traction strap means are integrated into a single unit.

* * * * *